US005987776A

United States Patent [19]

Holcombe et al.

[11] Patent Number: 5,987,776

[45] Date of Patent: Nov. 23, 1999

[54] PROCESS FOR DRYING AND SOLVENT-EXTRACTION OF WATER WET SOLIDS

[75] Inventors: Thomas C. Holcombe, Neshanic Station; Theodore D. Trowbridge, Madison, both of N.J.

[73] Assignee: American Biotheim Company LLC, Somerville, N.J.

[21] Appl. No.: 08/948,879

[22] Filed: Oct. 10, 1997

[51] Int. Cl.[6] ..... G26B 3/00

[52] U.S. Cl. ..... 34/330

[58] Field of Search ..... 34/302, 303, 305, 34/330, 338, 340, 349, 351; 159/100, 473, 905; 203/47.3, 88, 100; 210/774, 806

[56] References Cited

U.S. PATENT DOCUMENTS

| | | | |
|---|---|---|---|
| 2,663,089 | 12/1953 | Coats | 34/330 |
| 3,314,160 | 4/1967 | Forkner | 34/330 X |
| 4,276,115 | 6/1981 | Greenfield et al. | 159/47.1 |
| 4,642,904 | 2/1987 | Smith, Jr. | 34/349 |
| 5,037,561 | 8/1991 | Copeland | 34/349 X |
| 5,092,983 | 3/1992 | Eppig et al. | 208/323 |
| 5,107,874 | 4/1992 | Flanigan et al. | 134/60 |
| 5,256,251 | 10/1993 | Holcombe | 159/47.3 |
| 5,518,621 | 5/1996 | Holcombe et al. | 210/634 |
| 5,765,293 | 6/1998 | St. Louis et al. | 34/305 |

*Primary Examiner*—Henry Bennett
*Assistant Examiner*—Steve Gravini
*Attorney, Agent, or Firm*—E. Liebenstein

[57] ABSTRACT

This invention is an improved continuous process for drying and solvent extraction of water-wet solids without experiencing sticky solids comprising the steps of (1) mixing the input water-wet with solvent, (2) feeding said mixture into two or more stages of evaporation in parallel or in series to evaporate some of the water present in the input solids or sludges and to extract some of the indigenous solvent-soluble compounds from the solids, (3) feeding the slurry from the parallel or serial stages of evaporation in series to one or two final evaporation stages operated at pressures above atmospheric at preferably between pressures of 18 psia and 150 psia and more preferably between pressures of 18 psia and 50 psia, (4) feeding the slurry from the final stages of evaporation to a centrifuge or other device for separating most of the solvent from the solids, (5) subjecting the water-wet solids to none, one, or multiple extraction stages before, during, or after the evaporation stages, (6) at times, feeding the centrifuge centrate to a solvent distillation system to recover the extracted solvent-soluble compounds from the solvent, and (7) at times, feeding the final centrifuge cake to a desolventizer to remove and recover virtually all of the residual solvent from the solids.

14 Claims, 4 Drawing Sheets

PROCESS FOR DRYING AND SOLVENT-EXTRACTION OF WATER WET SOLIDS

BACKGROUND OF THE INVENTION

1. Field of the Invention

This invention relates to an improved process for the drying of water-wet solids of various kinds, for solvent-extraction of indigenous solvent-soluble compounds from said solids, and for recovering solids, water, and indigenous solvent-soluble compounds for further use. More particularly, it deals with improvements to a continuous process for drying and solvent-extraction of water-wet solids wherein the input material is mixed with water-immiscible solvents of various kinds to obtain a mixture that remains fluid and pumpable even after virtually all of the water has been removed (at least 85% of the water present in the feedstock), and to extract indigenous solvent-soluble compounds from the input material.

2. Discussion of the Prior Art

Drying and solvent-extraction of water-wet solids is the object of large and varied industries. Examples of water-wet solids requiring such treatment include, but are not limited to:

(1) Municipal and industrial sewage sludges, such as raw primary sludges, waste activated sludges, anaerobically digested sludges, and bio-sludges;

(2) Animal wastes, such as pig manures, wool-scouring wastes, chicken manures, and cow manures;

(3) Contaminated soils, such as soils contaminated with crude oils, fuel oils, polychlorinated biphenyls, polynuclear aromatics, coal tars, and oil drilling muds;

(4) Refinery sludges, such as API separator sludges, dissolved air flotation floats, and slop oil emulsion solids;

(5) Ink and dye sludges;

(6) Alum sludges;

(7) Wood pulp mill activated sludges and black liquors;

(8) Pharmaceutical plant wastes;

(9) Brewery sludges;

(10) Dairy and food products and wastes, such as milk whey by-products, coffee wastes, and chocolate wastes;

(11) Peats, lignites, and brown coals; and

(12) Meat rendering wastes.

Drying and solvent-extraction of water-wet solids present many processing problems relative to the efficiency and reliability of production. Various typical processes for dehydrating water-wet solids using solvent extraction technologies are disclosed in U.S. Pat. Nos. Re 26,317; Re 26,352; 3,323,575; 3,716,458; 3,855,079; 3,950,230; 4,013,516; 4,270,974; 4,418,458; 4,336,101; 4,702,798; 5,076,895; 5,256,251; and 5,518,621.

In general, the processes and apparatus described in the aforementioned patents involve slurrying water-wet solids, such as one or a combination of the types listed above, with a water-immiscible solvent to obtain a mixture which remains fluid and pumpable even after virtually all of the water has been removed. The properties of the solvent can be varied over a wide range to achieve the desired characteristics. The solvent should be immiscible in water and should have an atmospheric boiling point of 300° F. or higher to prevent excessive evaporation of the solvent during the evaporation of water from the solvent. The viscosity of the solvent should be low enough, typically less than 500 cp, so that the slurry is pumpable at the flowing temperatures. Extraction of compounds from the input water-wet solids can be enhanced by changing the chemical composition of the solvent to increase the solubility of the compounds in the solvent. The chemical composition of the solvent can also be adjusted to improve the dispersibility of the water-wet solids in the solvent. Isopar "L" and Ashland 140 Solvent 66 are the trade names for solvents which meet the above criteria and have been used in these processes. Iso-octanol is an example of another solvent which has been used in these processes.

The resulting mixture of solvent and water-wet solids is passed through a sequence of drying steps in which the mixture is dried by heat evaporation. Economies of energy consumption are realized by utilizing the evolved vapor from each evaporation step except for one, typically the first step to supply a substantial portion of the heat requirements of another evaporation step. The evaporation steps generate a slurry of dried or partially-dried solids in solvent which is withdrawn and fed to a centrifuge (or other apparatus for separating liquids from solids) to separate a substantial portion of the solvent from the solids. The solids leaving the centrifuge are sometimes processed further by heating them in a "desolventizer", referred to as a cake deoiler and an example of which is disclosed in U.S. Pat. No. 4,270,974. In the desolventizer, blowing steam, purge gas, and/or vacuum are used to recover most of the remaining solvent from the solids. In many cases, the centrifuge centrate is fed to a distillation system where the indigenous solvent-soluble compounds extracted from the solids are separated from the solvent and recovered for final disposition.

An important consideration in the design of a multi-effect evaporation drying facility is to select optimum operating conditions for the evaporation steps. Water evaporation rates are directly proportional to the temperature differentials between the condensing steam vapor on one side of the evaporator system heat exchangers and the material being dried on the other side of the heat exchangers. To create temperature differentials, the condensing temperature of the steam leaving some of the effects is reduced by operating the stages under vacuum; and to maximize the temperature differentials available, the lowest practical pressures are used. Thus, in the prior art, a common example would be to have three evaporators, with the first evaporator operating at about 1.5 psia, the third evaporator operating at atmospheric pressure (14.7 psia) and the second evaporator operating at an intermediate pressure. In a simplified example, the operating temperature (and the condensing temperature of the steam generated in that stage) would be about 116° F. in the first stage whereas the steam leaving the third evaporator would have a condensing temperature of about 212° F. Thus, the temperature differential to provide evaporation in the heat exchangers for the first and second evaporators would be about 96° F.

For example:

| | Operating Pressure | Operating Temperature | "Steam" Condensing Temperature |
|---|---|---|---|
| 1st Stage | 1.5 psia | 116° F. | 116° F. |
| 2nd Stage | 5.2 | 164 | 164 |
| 3rd Stage | 14.7 | 212 | 212 |
| Temperature Differentials: | | | |
| (3rd Stage Steam − 2nd Stage Operating) | | = 48° F. | |
| (2nd Stage Steam − 1st Stage Operating) | | = 48 | |
| Total | | 96° F. | |

However, all of this differential is not available to create heat transfer in the evaporator heat exchangers due to a phenomenon known as a boiling point rise. In prior practice, it had been found that the measured boiling point temperature of water when in contact with most types of solids is greater than the boiling point temperature of water at the same pressure when the solids are not present. This temperature difference is called a boiling point rise (BPR).

In practice, the BPR's for all stages in an evaporator system must be subtracted from the total temperature differential in order to determine the net amount of temperature differential available for heat transfer. Thus, in the above example, if the BPR's in the first and second evaporators were 10° F. each, the temperature differential available to provide evaporation in the first and second stage heat exchangers would total 96° F. minus 20° F. or 76° F.

To illustrate:

| | Operating Pressure | Operating Temperature | BPR | "Steam" Condensing Temperature |
|---|---|---|---|---|
| 1st Stage | 1.5 psia | 126° F. | 10° F. | 116° F. |
| 2nd Stage | 5.2 | 174 | 10 | 164 |
| 3rd Stage | 14.7 | 262 | 50 | 212 |
| Temperature Differentials: | | | | |
| (3rd Stage Steam − 2nd Stage Operating) | | | = 38° F. | |
| (2nd Stage Steam − 1st Stage Operating) | | | = 38 | |
| Total | | | 76° F. | |

In the prior art, it was believed that as the ratio of solids to water as increased and the BPR increased also; however, the BPR was strictly a function of the solids/water ratio and that for a particular solid, the BPR was unaffected by other variables, such as pressure or temperature. Thus, when practicing the prior art in designing or operating a multi-stage evaporator system, all that was required to be known was the solids/water ratio of the material being dried in a particular stage; this quantity then determined the BPR and from it the required design basis or operating conditions could be set. Furthermore, if it were desired to design or operate the evaporator system at a different pressure or temperature, only the solids/water ratio would be needed to predict the performance at the the new conditions. If the solids/water ratio was the same as that used previously, no additional data would be needed to predict the new performance.

However, for the present invention, it has been discovered that the BPR is actually a function of solids/water ratio and evaporator operating pressure and temperature. It was found through experimentation that different curves of BPR point rise versus solids/water ratio are obtained at different temperatures. In general, the higher the operating pressure and temperature, the lower the BPR for a given solids/water ratio.

Thus, if one were to contemplate the effect of increasing the operating pressure of the atmospheric pressure evaporator to significantly higher pressures, the associated higher operating temperature provides some unexpected benefits: Not only does the total temperature differential between the lowest and highest pressure evaporators increase, but the BPR unexpectedly declines, resulting in a larger than expected temperature differential available for heat transfer in the evaporator heat exchangers.

SUMMARY OF THE INVENTION

In accordance with the present invention, improved process operation results by subjecting a wet slurry comprising a mixture of water-wet solids and solvent through at least three dehydration steps employing at least two evaporation stages with the wet slurry fed to the first two stages serially or concurrently in a parallel arrangement relative to each other with pressures in the final evaporation stage being above atmospheric pressure. By way of definition, "evaporation stage" refers to the equipment in which slurry is heated and a portion of the water and solvent is evaporated and the evolved vapors are separated from the remaining slurry. The first stage of evaporation corresponds to the first step of dehydration and the second stage corresponds to the second step of dehydration, etc.

The evolved vapors from all but one of the stages of evaporation are used to heat other stages in a co-current, counter-current, or alternative arrangement relative to the slurry flow. Thus, the actual temperatures of the evolved vapors and the corresponding condensation temperatures directly affect the amount of heat which may be transferred in the stages and the amount of water which can be evaporated in each stage. The condensation temperature of the vapor is affected by the BPR which is the difference between the boiling point temperature of water in one stage and the condensation temperature of the water vapor evolved from that stage which is used to heat the solids/water/solvent mixture and evaporate the water in a subsequent stage. Thus, raising the pressures in the stages which corresponds to raising the temperature in the stages can raise the amount of heat which can be transferred and increase the water evaporation rate. An unexpected benefit is the finding that the BPR of the slurry declines with increasing temperature and consequently enhances the water evaporation rate.

Consequently, raising the pressure of the last stage of the evaporation system and the corresponding temperatures, increases the available total overall temperature difference in the system and increases the water evaporation rate. With this capability this invention may be used to: 1. increase the capacity (debottleneck) of existing oil-based water evaporation systems; 2. permit smaller, less expensive, heaters to be used for the same evaporation rate for new systems (grass-roots), and; 3. permit smaller vapor chambers and associated equipment to be used because of the higher operating pressures.

The improved process of the present invention broadly comprises a continuous process for drying and solvent extraction of water-wet solids comprising the steps of (a) forming a wet slurry mixture of said water-wet solids and a water immiscible solvent with said water immiscible solvent having an atmospheric boiling point above 300° F. and a viscosity of less than 500 cp, (b) passing said wet slurry mixture through a dehydration operation including at least three stages of evaporation with said wet slurry mixture fed serially to the first stage of evaporation or concurrently to at least the first two stages of evaporation in a parallel arrangement, (c) operating the final stage of evaporation at above atmospheric pressure, (c) separating the dehydrated waste solids from the water immiscible solvent, and (d) recycling said water immiscible solvent separated from said dehydrated waste solids in said continuous process for forming said wet slurry mixture.

BRIEF DESCRIPTION OF THE DRAWINGS

The advantage of the present invention will become apparent from the following detailed description when read in conjunction with the accompanying drawings of which.

DETAILED DESCRIPTION OF THE INVENTION

Figure 1:
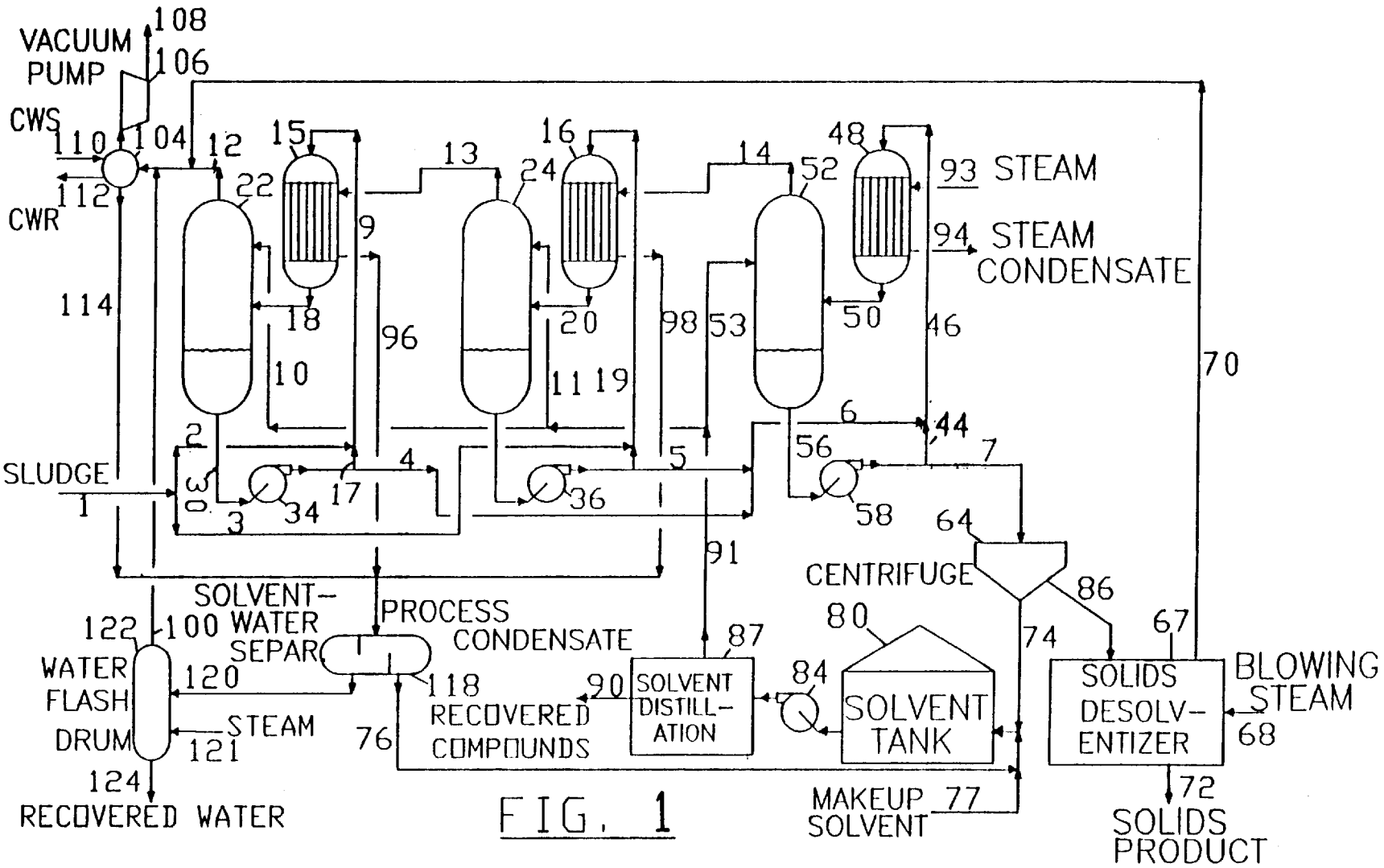
FIG. 1 is a detailed illustration of a preferred embodiment of the dehydration system for practicing the invention.

FIG. 1 provides a more detailed description of an example of the process wherein water-wet solids are dried in a relatively volatile solvent. An example input water-wet solid may contain 18% solids, 2% indigenous solvent-soluble compounds, and 80% water. The process can handle water-wet solids containing anywhere from less than 1 percent to over 90 percent solids and from 2% to 10% indigenous solvent-soluble compounds.

As defined earlier, an evaporation stage corresponds to equipment in which slurry is heated and a portion of the water and solvent is evaporated and the evolved vapors are separated from the remaining slurry. In FIG. 1, the first stage of evaporation corresponds to vapor-slurry separator 22, pump 34, heat exchanger 15, and the associated connecting piping. The second stage of evaporation corresponds to vapor-slurry separator 24, pump 36, heat exchanger 16, and the associated connecting piping. The third stage of evaporation corresponds to vapor-slurry separator 52, pump 58, heat exchanger 48, and the associated connecting piping. An evaporation stage is not limited to the equipment arrangement used in the present example. Any arrangement that meets the functions defined above is adequate.

The makeup solvent entering through line 77 consists of a hydro-refined paraffin oil having a narrow boiling range with an average boiling point of about 400° F. The input water-wet solid enters the system through input line number 1, is split approximately equally into two parallel lines, 2 and 3, and enters the first and second stages of evaporation in parallel.

In the first stage of evaporation, the input sludge from line 2 mixes with a slurry of partially-dried solids in solvent from line 17 and passes through line 9 into the tube side of heat exchanger 15. In the heat exchanger, about ⅓ of the water entering the system through line 1 (plus a portion of the solvent) is vaporized. The first stage of evaporation usually operates at a subatmospheric pressure, typically between 2 and 10 psia. The temperature of the slurry entering heat exchanger 15 through line 9 is typically 100 to 250° F., depending on the operating pressure. Heat exchanger 15 is heated on the shell side by mixed steam and solvent vapor from line 13 which is at a temperature higher than the temperature of the slurry on the tube side, typically 20° to 40° F. higher. Condensed water and solvent from heat exchanger 15 is conducted through line 96 to solvent-water separator 118. The slurry and evaporated water leave heat exchanger 15 through line 18 and enters vapor-slurry separator 22, where the vapor is separated from the slurry and enters line 12. The slurry is pumped out of vapor-slurry separator 22 through line 30 using pump 34. Most of the slurry passes through line 17, mixes with input material from line 2, and recycles back to heat exchanger 15 through line 9. The remaining slurry passes through line 4 and feeds the third evaporation stage. Replacement solvent is added to vapor-slurry separator 22 through line 10.

The vapor in line 12 mixes with vapor from other parts of the process (through line 70 and line 100) and the combined vapor passes into surface condenser 104, where a substantial portion of the water and solvent vapor is condensed. Cooling water enters and leaves the condenser through lines 110 and 112, respectively. The mixed condensate of water and solvent leaves condenser 104 through line 114 and passes into solvent-water separator 118. The non-condensed vapor from condenser 104 enters vacuum pump 106 and exits the system through vent line 108.

The second stage of evaporation operates in parallel with the first stage of evaporation and has the same features described above for the first stage of evaporation, except that the operating pressure and temperature is higher. The input water-wet solids enter the second stage of evaporation through line 3.

Product slurry streams from the first and second stages of evaporation pass through lines 4 and 5, respectively, and mix to form the combined slurry feed (line 6) to the third stage of evaporation. The combined feed mixes with dried or partially-dried slurry from line 44 and passes through line 46 into the tube side of heat exchanger 48. In the heat exchanger, the remaining water to be removed from the input material is vaporized. The final stage of evaporation (the third stage in this example) often runs at pressures close to atmospheric pressure, typically in the range of 12 to 17 psia. The temperature of the slurry is typically 200 to 300° F., depending upon the operating pressure. Heat exchanger 48 is heated on the shell side with live steam entering and condensate leaving the heat exchanger through lines 93 and 94, respectively. The slurry and evaporated water leave heat exchanger 48 through line 50 and enters vapor-slurry separator 52, where the vapor is separated from the slurry and enters line 14. The slurry is pumped out of vapor-slurry separator 52 through line 56 using pump 58. Most of the slurry passes through line 44, mixes with input material from line 6, and recycles back to heat exchanger 48 through line 46. The net product slurry from the third stage of evaporation passes through line 7 into centrifuge 64. Replacement solvent is added to vapor-slurry separator 52 through line 53.

Solids cake from centrifuge 64 passes through line 86 into solids desolventizer 67, where blowing steam from line 68 is used to evaporate most of the residual solvent on the solids. The virtually solvent-free solids leaves the battery-limits of the process through line 72. The blowing steam and evaporated solvent leave the solids desolventizer through line 70 and mix with the vapors leaving vapor-slurry separator 22 through line 12. The design of a solids desolventizer can vary considerably from the present example and is described in more detail in U.S. Pat. Nos. 4,270,974 and 4,518,458, the disclosures of which are herein incorporated by reference. An example of a desolventizer consists of an externally heated vessel in which the solids are slowly turned and pushed with rotating impellers and blowing steam is purged through the vessel to have intimate contact with the solids. U.S. Pat. No. 4,518,458 discusses an alternate version in which a heated recirculating purge gas in purged through the vessel instead of blowing steam.

Centrate removed by centrifuge 64 passes to solvent tank 80 through lines 74 and 78 for reuse in the process.

The solvent-water separator 118 receives solvent-water condensates from the surface condenser 104 through line 114, from the first stage heat exchanger 15 through line 96, and from second stage heat exchanger 16 through line 98. Inside solvent-water separator 118, the water is gravity separated from the solvent. The solvent is recirculated to solvent tank 80 through line 76. The water separated in solvent-water separator 118 is fed to water flash drum 122 through line 120. In water flash drum 122, almost all of the non-dissolved solvent left in the water is evaporated and passes into line 100. Sufficient supplemental steam is added through line 121 to cause of small fraction (less than 20 percent) of the water to be evaporated, thereby accomplishing the desired level of solvent removal. This system of removing residual solvent from the separated water is preferred over conventional coalescers since it is not hampered by the presence of residual fine solids which are typically present in the process condensates. Recovered water leaves the battery-limits of the process through line 124.

Makeup solvent is added to solvent tank 80 through line 77. Makeup and recycle solvent is fed to solvent distillation system 87 using pump 84. In solvent distillation system 87, solvent soluble compounds extracted from the input sludge are recovered from the solvent by suitable means, such as fractional distillation. The recovered extracted compounds leave the battery-limits of the process through line 90. The purified solvent is recirculated back to the vapor-slurry separators through line 91. The design of solvent distillation system 87 can vary considerably and some versions are described in U.S. Pat. No. 4,289,578, the disclosure of which is herein incorporated by reference. An example of a solvent distillation system consists of a single stage flash in which most of the solvent is evaporated overhead, and the non-evaporated liquid, composed of approximately 50 percent solvent and 50 percent indigenous solvent-soluble compounds, is subsequently fed to a second flash stage in which stripping steam is added to evaporate virtually all of the remaining solvent from the indigenous solvent-soluble compounds.

The drying (water removal) capacity of an evaporation system is determined by the heat transfer rate which in turn is a function of the heat transfer coefficient and surface area of a heat exchanger and the temperature difference between the fluids passing through the heat exchanger. For example, in FIG. 1, the temperature differences of interest are determined by the condensing temperature of stream 13 and the steam and slurry temperature of stream 18; also the condensing temperature of stream 14 and the steam and slurry temperature of stream 20. The available total temperature difference between the condensing temperature of the live steam (Stream 93 in FIG. 1) in the final stage and the operating temperature of the first stage (Stream 3 in FIG. 1) will help determine the water evaporation rate in heat exchangers 15, 16 and 48.

The available total overall temperature difference for a given system is less than the temperature difference calculated by simply subtracting the operating temperature of the first stage from the condensing steam temperature of the final stage due to the property of the boiling point rise (BPR) in each stage. The BPR is the difference between the actual boiling point of water in a given stage and the predicted usual boiling point of water at the same pressure. It is a characteristic of water-wet solids that they must be heated to some temperature above the normal boiling point of water at the particular operating stage pressure before the water will be vaporized but the water will not condense until it is cooled to its boiling point at the particular pressure.

Figure 2:
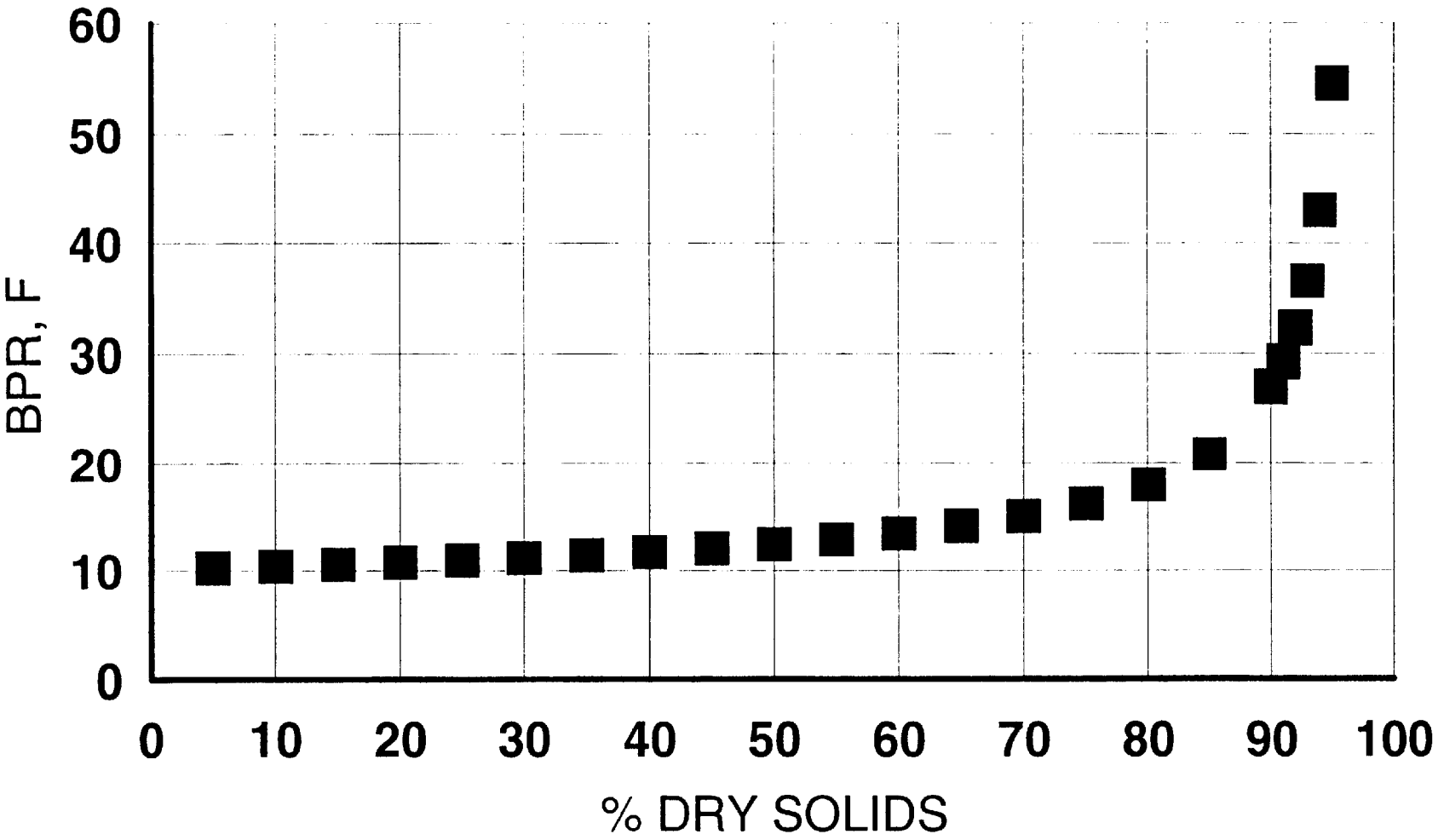
FIG. 2 is an illustration of the method for determining boiling point rises (BPR's) used previously for the technology.

Previously, it was believed that the BPR for all water-solids mixtures was a function only of the amount of dry solids present with respect to the water present; % dry solids=100×wt. solids/(wt. solids+wt. water) as shown in FIG. 2. Thus, the effective overall temperature difference for an evaporation system was a function only of the system itself and the % dry solids of material being dried and was independent of the system operating temperatures.

It has been recently discovered experimentally however, that the BPR for a particular water-wet solids being dried is a function of the origin or type of water-wet solids, the % dry solids present and the operating temperatures of the system. As an example, this finding is shown for a type of municipal sewage sludge called wasted activated sludge (WAS) in FIG. 3.

It is presently theorized that the BPR for the water-wet solids is caused by the affinity of the solids for water. This requires higher temperatures than the boiling point of water for the water to be released from the solids. The recent discovery shows that the affinity is lower at higher temperatures and hence the BPR is lower at higher temperatures for a given water content of the solids.

Raising the pressure of the last stage of the evaporation system and intermediate stages and the corresponding temperatures, increases the available total overall temperature difference in the system and increases the water evaporation rate. With this capability this invention may be used to: 1. increase the capacity (debottleneck) of existing oil-based water evaporation systems; 2. permit smaller, less expensive, heaters to be used for the same evaporation rate for new systems (grass-roots), and; 3. permit smaller vapor chambers and associated equipment to be used because of the higher operating pressures.

Because of the fact that the BPR goes down as the operating pressure and temperature goes up, raising the pressure of the last stage and intermediate stages results in benefits not expected when practicing the prior art.

In all the examples presented and the descriptions given here the impact of the presence of the solvent in the multi-effect evaporator system on the operating conditions has been taken into consideration and corrected for as required.

The unexpected advantages of these findings are illustrated in the following examples:

EXAMPLE 1

A WAS (wasted activated municipal sewage sludge) with composition 22.8 wt % solids, 1.2% indigenous oil, and 76 wt % water (% Dry Solids=wt. solids×100/(wt. solids+wt. water)) is to be dried in a 3-stage evaporator system using a parallel feed system as described in U.S. Pat. No. 5,256,251 and illustrated in FIG. 1 under the following conditions:

Conventional final stage pressure, approximately atmospheric, and temperature;

1.5 psia pressure in the first stage;

BPR calculations are a function of % dry solids content and are independent of temperature as shown in FIG. 2 (conventional method);

| | Stage 1 | Stage 2 | Stage 3 | Total |
|---|---|---|---|---|
| % Dry Solids Product | 49.3 | 49.3 | 95.0 | |
| Operating Pressure, psia | 1.5 | 4.9 | 14.6 | |
| Operating Temperature, ° F. | 125.9 | 171.2 | 258.9 | |
| BPR ° F. | 12.4 | 12.4 | 54.6 | 79.4 |
| "Heating" Steam Temp. ° F. (from previous stage to Stages 1 and 2) | 158.8 | 204.3 | — | |
| Effective Temp Diff., ° F. | 32.9 | 33.1 | — | 66.0 |

EXAMPLE 2

The following results are obtained if WAS with the composition of Example 1 is dried in a 3-stage evaporator system at the following conditions:

Stage 3 operating pressure of 18.2 psia, 270° F.;

BPR calculations are a function of % dry solids content and are independent of temperature as shown in FIG. 2 (conventional method);

| | Stage 1 | Stage 2 | Stage 3 | Total |
|---|---|---|---|---|
| % Dry Solids Product | 49.3 | 49.3 | 95.0 | |
| Operating Pressure, psia | 1.5 | 5.6 | 18.2 | |
| Operating Temperature, ° F. | 125.9 | 181.8 | 270.0 | |
| BPR ° F. | 12.4 | 12.4 | 54.6 | 79.4 |
| Heating" Steam Temp. ° F. (from previous stage to stages 1 and 2) | 164.4 | 215.4 | — | |
| Effective Temp Diff., ° F. | 38.5 | 38.6 | — | 77.1 |

Comparison of Example 2 with Example 1 demonstrates that, if the temperature of the operation is increased when the BPR has been conventionally a function of the % dry solids only in the evaporating mixture, the effective temperature difference is is raised, 77.1–66.0=11.1° F. (a percentage increase of 16.8%) by the amount of increase in the operating temperature of the final stage, 270.0–258.9=11.1° F.

EXAMPLE 3

The following results are obtained if WAS with the composition of Example 1 is dried in a 3-stage evaporator system at the following conditions:

Stage 3 operating pressure of 20.1 psia, 275° F.;

BPR calculations are a function of % dry solids content and are independent of temperature as shown in FIG. 2 (conventional method);

| | Stage 1 | Stage 2 | Stage 3 | Total |
|---|---|---|---|---|
| % Dry Solids Product | 49.3 | 49.3 | 95.0 | |
| Operating Pressure, psia | 1.5 | 6.0 | 20.1 | |
| Operating Temperature, ° F. | 125.9 | 179.4 | 275.0 | |
| BPR ° F. | 12.4 | 12.4 | 54.6 | 79.4 |
| Heating" Steam Temp. ° F. (from previous stage to stages 1 and 2) | 167.0 | 220.4 | — | |
| Effective Temp Diff., ° F. | 41.1 | 41.0 | — | 82.1 |

Comparison of Example 3 with Example 1 demonstrates that, if the temperature of the operation is increased when the BPR has been conventionally a function of the % dry solids only in the evaporating mixture, the effective temperature difference is is raised, 82.1–66.0=16.1° F. (a percentage increase of 24.4%) by the amount of increase in the operating temperature of the final stage, 275.0–258.9=16.1° F.

EXAMPLE 4

The following results are obtained if WAS with the composition of Example 1 is dried in a 3-stage evaporator system at the following conditions:

Stage 3 operating pressure of 34.6 psia, 304.8° F.;

BPR calculations are a function of % dry solids content and are independent of temperature as shown in FIG. 2 (conventional method);

| | Stage 1 | Stage 2 | Stage 3 | Total |
|---|---|---|---|---|
| % Dry Solids Product | 49.1 | 49.1 | 95.0 | |
| Operating Pressure, psia | 1.5 | 8.3 | 34.6 | |
| Operating Temperature, ° F. | 125.9 | 194.2 | 304.8 | |
| BPR ° F. | 12.4 | 12.4 | 54.6 | 79.4 |
| Heating" Steam Temp. ° F. (from previous stage to stages 1 and 2) | 181.8 | 250.2 | — | |
| Effective Temp Diff., ° F. | 55.9 | 56.0 | — | 111.9 |

Comparison of Example 4 with Example 1 demonstrates that, if the temperature of the operation is increased when the BPR has been conventionally a function of the % dry solids only in the evaporating mixture, the effective temperature difference is is raised, 111.9–66.0=45.9° F. (a percentage increase of 69.5%) by the amount of increase in the operating temperature of the final stage, 304.8–258.9=45.9° F.

EXAMPLE 5

The following results are obtained if WAS with the composition of Example 1 is dried in a 3-stage evaporator system at the following conditions:

Stage 3 operating pressure of 100 psia, 372.1° F.;

BPR calculations are a function of % dry solids content and are independent of temperature as shown in FIG. 2 (conventional method);

| | Stage 1 | Stage 2 | Stage 3 | Total |
|---|---|---|---|---|
| % Dry Solids Product | 48.9 | 48.9 | 95.0 | |
| Operating Pressure, psia | 1.5 | 16.8 | 100.0 | |
| Operating Temperature, ° F. | 125.9 | 227.7 | 372.1 | |
| BPR ° F. | 12.4 | 12.4 | 54.6 | 79.4 |
| Heating" Steam Temp. ° F. (from previous stage to stages 1 and 2) | 215.4 | 317.5 | — | |
| Effective Temp Diff., ° F. | 89.5 | 89.8 | — | 179.3 |

Comparison of Example 5 with Example 1 demonstrates that, if the temperature of the operation is increased when the BPR has been conventionally a function of the % dry solids only in the evaporating mixture, the effective temperature difference is is raised, 179.3–66.0=113.3° F. (a percentage increase of 171.5%) by the amount of increase in the operating temperature of the final stage, 372.1–258.9=113.2° F.

EXAMPLE 6

Figure 3:
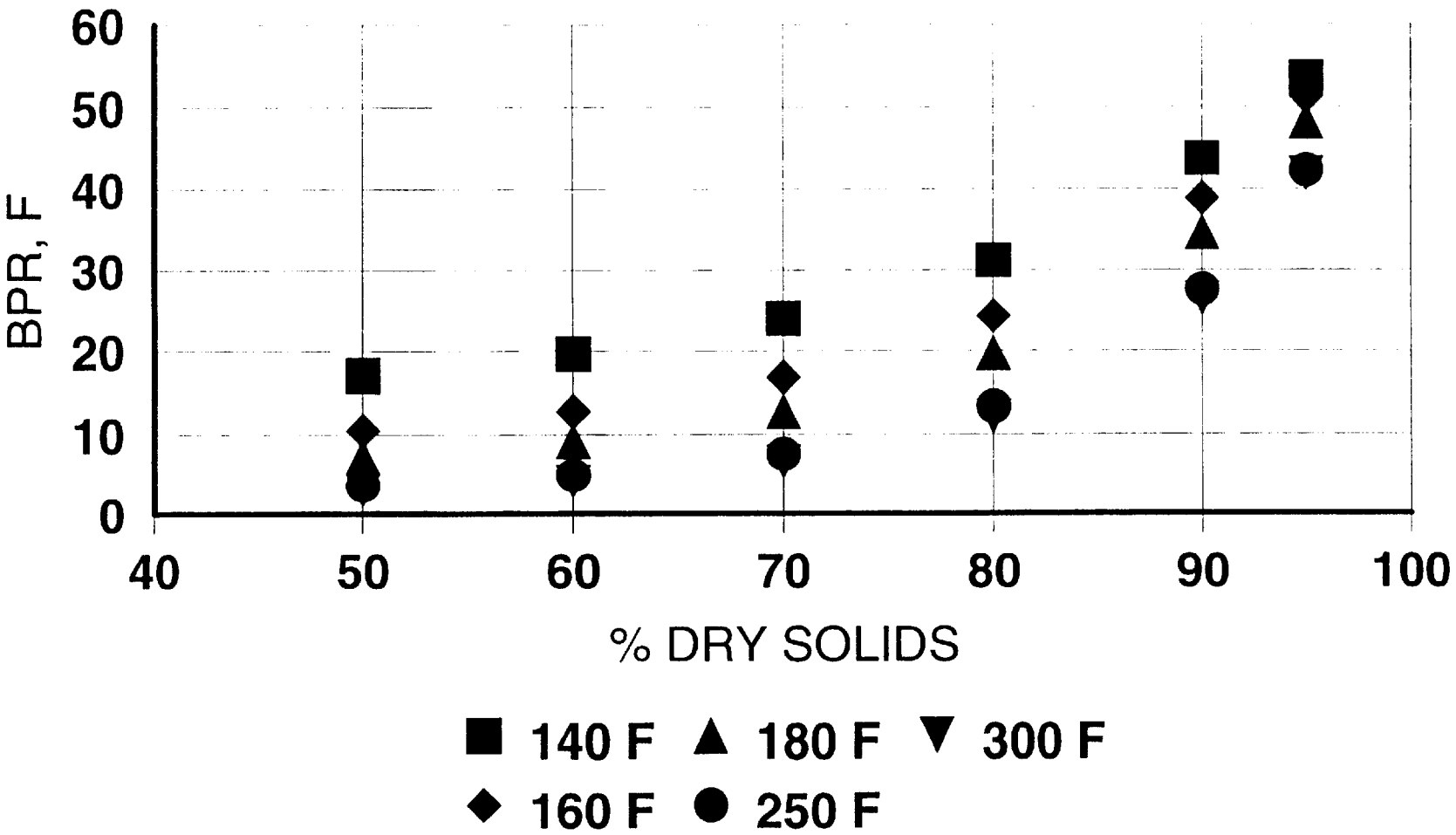
FIG. 3 is an illustration of the method for determining boiling point rises (BPR's) revealed in this invention.

The following results are obtained if WAS with the composition of Example 1 is dried in a 3-stage evaporator system with the stage 3 operating pressure of 14.6 psia (the same pressure as that of Example 1) and the BPR's used are those which are both a function of temperature and solids content per FIG. 3 in accordance with with this invention.

| | Stage 1 | Stage 2 | Stage 3 | Total |
|---|---|---|---|---|
| % Dry Solids Product | 48.1 | 48.1 | 95.0 | |
| Operating Pressure, psia | 1.5 | 5.7 | 14.6 | |
| Operating Temperature, ° F. | 133.3 | 173.5 | 248.1 | |
| BPR ° F. | 20.2 | 7.8 | 42.3 | 70.3 |

-continued

| | Stage 1 | Stage 2 | Stage 3 | Total |
|---|---|---|---|---|
| "Heating" Steam Temp. ° F. (from previous stage to stages 1 and 2) | 165.3 | 205.8 | — | |
| Effective Temp Diff., ° F. | 32.4 | 32.3 | — | 164.7 |

EXAMPLE 7

The following results are obtained if WAS with the composition of Example 1 is dried in a 3-stage evaporator system with the stage 3 operating pressure of 18.2 psia (the same pressure as that of Example 2) and the BPR's used are those which are both a function of temperature and solids content per FIG. 3 in accordance with with this invention.

| | Stage 1 | Stage 2 | Stage 3 | Total |
|---|---|---|---|---|
| % Dry Solids Product | 48.1 | 48.1 | 95.0 | |
| Operating Pressure, psia | 1.5 | 6.6 | 18.2 | |
| Operating Temperature, ° F. | 133.3 | 178.7 | 259.0 | |
| BPR ° F. | 20.2 | 7.2 | 42.1 | 69.5 |
| "Heating" Steam Temp. ° F. (from previous stage to stages 1 and 2) | 171.6 | 216.9 | — | |
| Effective Temp Diff., ° F. | 38.2 | 38.2 | — | 76.4 |

Comparison of Example 7 with Example 6 demonstrates that, if the pressure of the operation is increased when the BPR is according the the present invention a function of both the % dry solids and the temperature of the mixture, the effective temperature difference is is raised, 76.4–64.7=11.7° F. (a percentage increase of 18.1%) whereas the increase in the operating temperature of the final stage is only, 259.0–248.1=10.9° F.

EXAMPLE 8

The following results are obtained if WAS with the composition of Example 1 is dried in a 3-stage evaporator system with the stage 3 operating pressure of 24.8 psia, 275° F. (the same temperature as that of Example 3) and the BPR's used are those which are both a function of temperature and solids content per FIG. 3 in accordance with with this invention.

| | Stage 1 | Stage 2 | Stage 3 | Total |
|---|---|---|---|---|
| % Dry Solids Product | 48.0 | 48.0 | 95.0 | |
| Operating Pressure, psia | 1.5 | 7.9 | 24.8 | |
| Operating Temperature, ° F. | 133.4 | 186.6 | 275.0 | |
| BPR ° F. | 20.4 | 6.6 | 41.8 | 68.8 |
| "Heating" Steam Temp. ° F. (from previous stage to stages 1 and 2) | 179.9 | 233.2 | — | |
| Effective Temp Diff., ° F. | 46.5 | 46.7 | — | 93.2 |

Comparison of Example 8 with Example 6 demonstrates that, if the pressure and temperature of the operation is increased when the BPR is according the the present invention a function of both the % dry solids and the temperature of the mixture, the effective temperature difference is is raised, 93.2–64.7=28.5° F. (a percentage increase of 44.0%) whereas the increase in the operating temperature of the final stage is only, 275.0–248.1=26.9° F.

EXAMPLE 9

The following results are obtained if WAS with the composition of Example 1 is dried in a 3-stage evaporator system with the stage 3 operating pressure of 41.9 psia, 304.8° F. (the same temperature as that of Example 4) and the BPR's used are those which are both a function of temperature and solids content per FIG. 3 in accordance with with this invention.

| | Stage 1 | Stage 2 | Stage 3 | Total |
|---|---|---|---|---|
| % Dry Solids Product | 47.9 | 47.9 | 95.0 | |
| Operating Pressure, psia | 1.5 | 11.1 | 41.9 | |
| Operating Temperature, ° F. | 133.4 | 200.9 | 304.8 | |
| BPR ° F. | 20.4 | 5.3 | 41.8 | 67.5 |
| "Heating" Steam Temp. ° F. (from previous stage to stages 1 and 2) | 195.8 | 263.0 | — | |
| Effective Temp Diff., ° F. | 62.2 | 62.1 | — | 124.3 |

Comparison of Example 9 with Example 6 demonstrates that, if the pressure and temperature of the operation is increased when the BPR is according the the present invention a function of both the % dry solids and the temperature of the mixture, the effective temperature difference is is raised, 124.3–64.7=59.6° F. (a percentage increase of 92.1%) whereas the increase in the operating temperature of the final stage is only, 304.8–248.1=56.7° F.

EXAMPLE 10

The following results are obtained if WAS with the composition of Example 1 is dried in a 3-stage evaporator system with the stage 3 operating pressure of 114.5 psia, 372.0° F. (the same temperature as that of Example 5) and the BPR's used are those which are both a function of temperature and solids content per FIG. 3 in accordance with with this invention.

| | Stage 1 | Stage 2 | Stage 3 | Total |
|---|---|---|---|---|
| % Dry Solids Product | 47.9 | 47.9 | 95.0 | |
| Operating Pressure, psia | 1.5 | 21.1 | 114.5 | |
| Operating Temperature, ° F. | 133.3 | 232.9 | 372.0 | |
| BPR ° F. | 20.3 | 4.0 | 43.5 | 67.8 |
| "Heating" Steam Temp. ° F. (from previous stage to stages 1 and 2) | 228.9 | 328.5 | — | |
| Effective Temp Diff., ° F. | 95.6 | 95.6 | — | 191.2 |

Comparison of Example 10 with Example 6 demonstrates that, if the pressure and temperature of the operation is increased when the BPR is according the the present invention a function of both the % dry solids and the temperature of the mixture, the effective temperature difference is is raised, 191.2–64.7=126.5° F. (a percentage increase of 195.5%) whereas the increase in the operating temperature of the final stage is only, 372.0–248.1=123.9° F.

To summarize the results of the above examples, the following table lists the percentage increase and thereby the improvement of this invention of the effective temperature differences over the base in the examples with comparable conditions for both the conventional technique (percent dry solids only) for BPR calculations, Examples 1 through 5, and the technique of this invention (percent dry solids and operating temperature), Examples 6 through 10.

| Comparable Condition | Conventional Technique Example No. | Conventional Technique Eff. Temp. Diff. % Over Base | This Invention Technique Example No. | This Invention Technique Eff. Temp. Diff. % Over Base |
|---|---|---|---|---|
| 14.6 psia | 1 | Base | 6 | Base |
| 18.2 psia | 2 | 16.8 | 7 | 18.1 |
| 275° F. | 3 (20.1 psia) | 24.4 | 8 (24.8 psia) | 44.0 |
| 304.8° F. | 4 (34.6 psia) | 69.5 | 9 (41.9 psia) | 92.1 |
| 372° F. | 5 (100 psia) | 171.5 | 10 (114.5 psia) | 195.5 |

While the invention has been illustrated in the examples involving three stages of evaporation (two "parallel feed flow" stages followed by a third drying stage in series, with counter-current sequential flow for the evolved vapors); the invention may be used with other parallel feed evaporation configurations as well. For example, it may be advantageous to have three "parallel feed flow" stages, followed in series by none, one or two drying stages.

This improved process may also be utilized in a serial system of water evaporation from water-wet solids mixtures as illustrated in U.S. Pat. No. 4,608,120 and other patents referenced above. In this case the feed solids are introduced to the first evaporation stage of the evaporation system and as they are dried pass in sequence through the following stages in series. Evolved vapors flow counter-currently to the solids through the system.

This improved process may also be utilized in a system using mechanical recompression evaporators and a serial system of water evaporation from water-wet solids mixtures as illustrated in U.S. Pat. No. 5,076,895. In this case the feed solids are introduced to the first evaporation stage of the evaporation system where heat is provided by recompression of the vapors from this stage; the partially dried solids as they are dried pass in sequence through one or more following stages in series. Evolved vapors from the final stages flow counter-currently to the solids through these stages.

Figure 4:
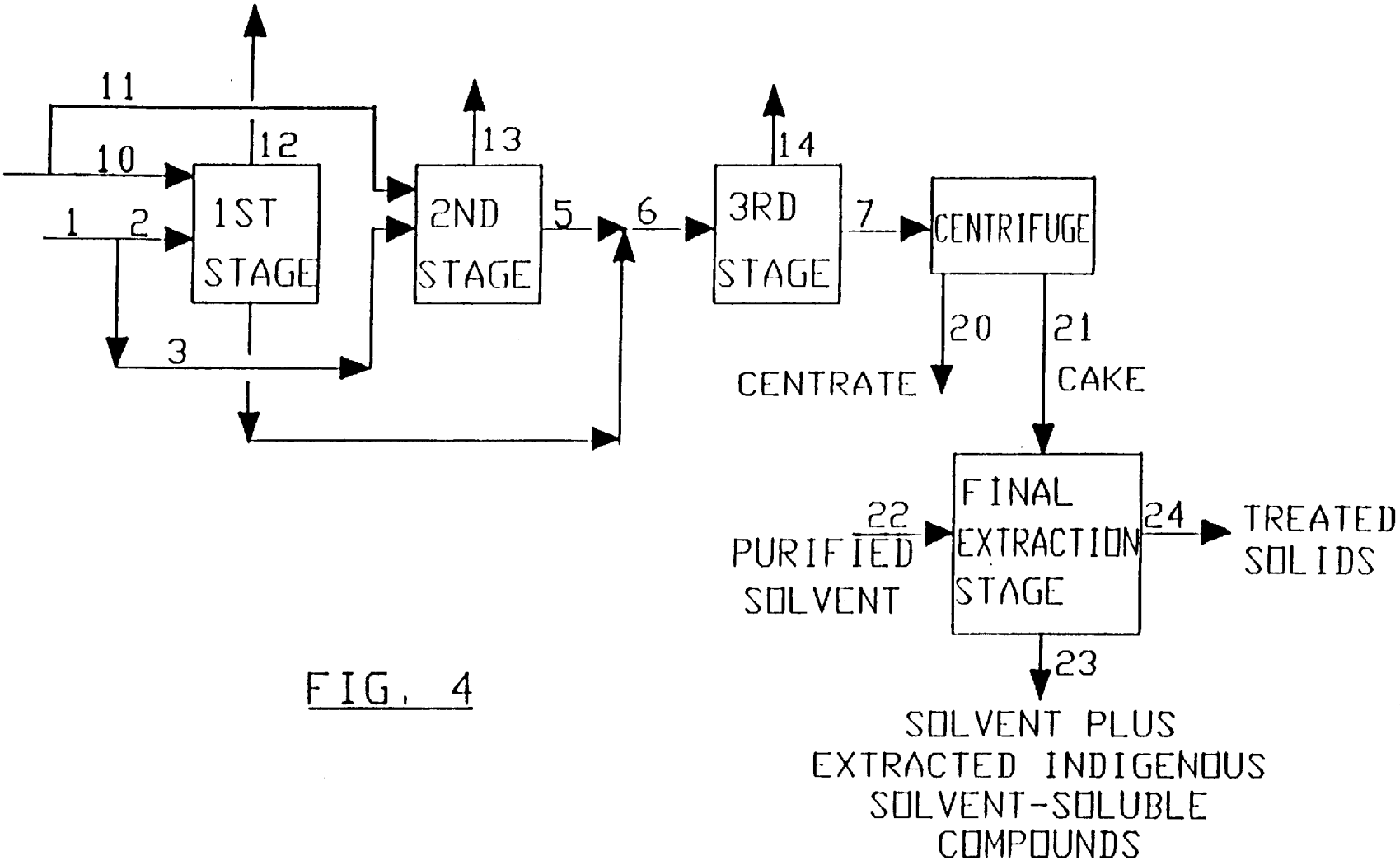
FIG. 4 is a block diagram of a solvent extraction process for practicing this invention.

Similarly, this improved process may be used with parallel and serial extraction stages as described in U.S. Pat. No. 5,518,621 and shown conceptually in FIG. 4.

In another variation, the centrifuge cake is sent to battery-limits without passing first through a solids desolventizer. This is often practiced when the solids are to be burned to produce energy.

What is claimed is:

1. A continuous process for drying water-wet solids comprising the steps of:

a. forming a wet slurry mixture of said water-wet solids and a water immiscible solvent with said water-immiscible solvent having an atmospheric boiling point above 300° F. and a viscosity of less than 500 centipoise;

b. passing said wet slurry mixture through a dehydration operation so as to remove virtually all the water (at least 85% of the water present) from said water-wet solids including at least three stages of evaporation with said wet slurry mixture fed concurrently to at least the first two stages of evaporation in a parallel arrangement;

c. operating such that the pressure in the final stage of evaporation is between 18 psia and 150 psia such that the boiling point rise declines with increasing operating temperature;

d. separating the dehydrated waste solids from the water immiscible solvent; and e. recycling said water immiscible solvent separated from said dehydrated waste solids in said continuous process for forming said wet slurry mixture.

2. A process, as defined in claim 1, operating such that the pressure in the final stage of evaporation is between 18 psia and 50 psia.

3. A process, as defined in claim 2, wherein said water-wet solids includes from about one percent (1%) to about ninety percent (90%) solids, from about ten percent (10%) to ninety-nine percent (99%) water, and from eighty-nine percent (89%) to zero percent (0%) indigenous solvent-soluble compounds.

4. A process, as defined in claim 3, wherein said separating step comprises a mechanical stage of separation to separate a substantial portion of the solvent from said dehydrated water-wet solids.

5. A process, as defined in claim 4, wherein said separated solvent is fed to a solvent distillation system wherein said water immiscible solvent is recovered and separated from the indigenous solvent-soluble compounds.

6. A process, as defined in claim 3, wherein said wet slurry mixture is fed in approximately equal volume percent to each of said parallel stages of evaporation.

7. A process, as defined in claim 6, wherein said dehydration operation includes a minimum of three stages of evaporation arranged in parallel, feeding a fourth stage of evaporation in series.

8. A process, as defined in claim 6, further comprising the step of extracting said indigenous solvent soluble compounds from said water-wet solids either before, after or during any of the stages of evaporation by contracting said water-wet solids with purified water immiscible solvent, and separating the solvent containing extracted indigenous solvent soluble compounds from the treated water-wet solids.

9. A process, as defined in claim 7, wherein each stage of evaporation includes a vapor slurry separator, a heat exchanger, and a pump.

10. A process, as defined in claim 9, wherein said separated water is further treated in a water flash drum to evaporate the non-dissolved solvent left in the water.

11. A process, as defined in claim 10, wherein said wet slurry mixture is formed by combining water-wet solids with water immiscible solvent in an agitation tank.

12. A process, as defined in claim 5, wherein said separating step further comprises a further stage of separation, wherein said separated solids from the first stage is passed through a solids desolventizer to recover residual solvent on the solids.

13. A process, as defined in claim 3, wherein water evaporation is performed in two or more evaporation stages arranged in series.

14. A process, as defined in claim 3, wherein water evaporation is performed first in a evaporation stage utilizing mechanical vapor recompression to provide heat to that stage followed by one or two or more evaporation stages arranged in series.

* * * * *